US008387168B2

(12) United States Patent
Bautista

(10) Patent No.: US 8,387,168 B2
(45) Date of Patent: Mar. 5, 2013

(54) PROTECTIVE GLOVE FOR HOCKEY AND SIMILAR SPORTS

(76) Inventor: Errol Bautista, Vancouver (CA)

( * ) Notice: Subject to any disclaimer, the term of this patent is extended or adjusted under 35 U.S.C. 154(b) by 0 days.

(21) Appl. No.: 12/629,855

(22) Filed: Dec. 2, 2009

(65) Prior Publication Data

US 2011/0126342 A1 Jun. 2, 2011

(51) Int. Cl.
*A41D 19/00* (2006.01)

(52) U.S. Cl. ..... 2/161.1; 2/163

(58) Field of Classification Search ..... 2/16, 18, 2/20, 158, 159, 161.1, 161.2, 161.3, 161.4, 2/161.5, 161.6, 161.8, 162, 163, 164
See application file for complete search history.

(56) References Cited

U.S. PATENT DOCUMENTS

| | | | | | |
|---|---|---|---|---|---|
| 944,949 | A | * | 12/1909 | Cormey | 2/158 |
| 1,286,771 | A | * | 12/1918 | Raymond | 2/158 |
| 1,786,227 | A | * | 12/1930 | Bruggeman | 2/159 |
| 2,251,027 | A | * | 7/1941 | Baker | 2/16 |
| 3,299,441 | A | * | 1/1967 | Slimovitz | 2/158 |
| 3,605,117 | A | * | 9/1971 | Latina | 2/16 |
| 3,626,515 | A | * | 12/1971 | Murray | 2/16 |
| 4,411,024 | A | * | 10/1983 | Hayes | 2/20 |
| 4,615,049 | A | * | 10/1986 | Samelian | 2/163 |
| 4,662,006 | A | * | 5/1987 | Ross, Jr. | 2/158 |
| 4,704,743 | A | * | 11/1987 | Thornell et al. | 2/161.1 |
| 4,787,376 | A | * | 11/1988 | Eisenberg | 2/20 |
| 4,815,147 | A | * | 3/1989 | Gazzano et al. | 2/161.1 |
| 4,930,162 | A | * | 6/1990 | Cote | 2/20 |
| 4,933,992 | A | * | 6/1990 | Kallman | 2/160 |
| 5,237,703 | A | * | 8/1993 | Brine et al. | 2/16 |
| 5,328,449 | A | * | 7/1994 | Andrews et al. | 602/42 |
| 5,329,639 | A | * | 7/1994 | Aoki | 2/161.1 |
| 5,444,874 | A | * | 8/1995 | Samelian et al. | 2/159 |
| 5,511,243 | A | * | 4/1996 | Hall et al. | 2/16 |
| 5,517,693 | A | * | 5/1996 | Noonan | 2/159 |
| 5,774,894 | A | * | 7/1998 | Yates et al. | 2/158 |
| 5,781,929 | A | * | 7/1998 | Shikatani | 2/16 |
| 5,787,896 | A | * | 8/1998 | Sackett | 128/880 |
| 5,946,720 | A | * | 9/1999 | Sauriol | 2/16 |
| 5,983,396 | A | * | 11/1999 | Morrow et al. | 2/161.1 |
| 6,014,774 | A | * | 1/2000 | Davey et al. | 2/158 |
| 6,122,769 | A | * | 9/2000 | Wilder et al. | 2/16 |
| 6,338,163 | B1 | * | 1/2002 | Markson | 2/163 |
| 6,732,376 | B2 | * | 5/2004 | Hoffman | 2/161.1 |
| 6,810,530 | B2 | * | 11/2004 | Bryant, Sr. | 2/159 |
| 7,313,830 | B2 | * | 1/2008 | Desjardins et al. | 2/161.1 |
| 7,458,107 | B2 | * | 12/2008 | Desjardins et al. | 2/161.1 |

* cited by examiner

*Primary Examiner* — Gary L Welch
*Assistant Examiner* — Brieanna Fuller

(57) ABSTRACT

A protective glove comprising a glove body having a padded cuff, an exterior covered with padding, finger pockets and a thumb pad, a palm flap integrally connected to the glove body adjacent the opening of the finger pockets such that the interior surface of the palm flap can be positioned to face the interior surface of the glove body, the palm flap further including a thumb pad pocket adapted to receive the thumb pad of the glove body, and an adjacent thumb pocket for receiving the wearer's thumb, flexible releasable fasteners situated along the periphery of the palm flap and at corresponding locations on the glove body for releasably connecting the palm flap to the glove body such that the palm flap and the glove body define a hand cavity when they are connected that communicates with the finger pockets.

12 Claims, 7 Drawing Sheets

PROTECTIVE GLOVE FOR HOCKEY AND SIMILAR SPORTS

BACKGROUND OF THE INVENTION

1. Field of the Invention

The present invention relates to a protective glove for hockey and similar sports requiring protective gloves padded on the back side of the hand, specifically the invention relates to a hockey glove which may be opened to expose the inside of the glove.

2. Description of Related Art

In sports such as hockey, lacrosse and similar contact sports, players require padded gloves to protect their fingers and hands from injury due to the physical contact of the game. Typically, the glove includes padded finger pockets or stalls as well as padded portions for protecting the hand, wrist, and lower forearm. These known gloves usually have finger pockets in which the protective padding for the fingers takes the form of long and narrow pads which extend lengthwise along the finger and are often provided with at least one transverse weakening or joint in order to facilitate the bending of the fingers. The padding for protecting of the back of the hand usually consist of a number of larger cushions which are separated from each other in order to allow bending of the hand. Protection for the thumb is usually provided by a padded cushion that extends along the outer side of the thumb and in which a relatively stiff protective strip is embedded. Some thinner padded cushions are also provided in the cuff of the glove along the upper forearm and a relatively stiff protective plate with padding can be placed in the cuff in order to cover the inside of the forearm.

Protective gloves of this type have proved to be comparatively satisfactory but have also shown disadvantageous. Ice hockey or other similar contact sports require vigorous activity, and over a prolonged period, the palm area of the glove collects moisture from player perspiration as well as from melted ice. Conventional gloves allow little air circulation, which means that the inside of the gloves remains wet or damp for long periods after use. Over time, bacteria build up on the palm and on the liners of the glove, causing undesirable odors and an unsanitary condition that can lead to infections of the player's hands.

An attempt to overcome this problem is found in U.S. Pat. No. 5,329,639 to Aoki, which discloses a protective glove for ice hockey wherein the palm area can be removed and replaced. The glove is formed of a back member covering the back of the user's hand and having the exterior surface of the back member covered with padding appropriate to protect the user's hand. A removable front portion is attached to the back member by a zipper, which extends around the peripheral edges of the glove. While the glove disclosed by Aoki allows the glove to be opened for increased air circulation, the use of a zipper as disclosed would produce a relatively inflexible peripheral ridge on the glove, which would impede the player's dexterity and the ability to handle the hockey stick, or like implement. Furthermore, the glove in Aoki lacks the close fit and overall comfort that conventional hockey gloves produce and that is required for skilful play.

Accordingly there is a need for a protective glove, such as for playing hockey and similar contact sports, that has the ability to be opened to expose the internal liners for drying, cleaning or replacement, and which maintains the overall fit and feel characteristics offered by conventional gloves. The protective gloves of the present invention are provided to fulfill this need as will be understood from the following description.

SUMMARY OF THE INVENTION

The above shortcomings may be addressed by providing, in accordance with one aspect of the invention, a protective glove for ice hockey, or similar sport requiring a glove with padding on the back of the hand, comprising a glove body having a padded cuff, an interior surface and an exterior surface that is substantially covered with padding, the glove body further including a plurality of finger pockets and a thumb pad, a palm flap having an interior surface and an exterior surface and being integrally connected to the glove body adjacent the opening of the finger pockets such that the interior surface of the palm flap can be positioned to face the interior surface of the glove body, the palm flap further including a thumb pad pocket adapted to receive the thumb pad of the glove body, and an adjacent thumb pocket for receiving the wearer's thumb, a plurality of flexible releasable fasteners situated along the periphery of the palm flap and at corresponding locations on the glove body for releasably connecting the palm flap to the glove body such that the palm flap and the glove body define a hand cavity when they are connected that communicates with the finger pockets. In some embodiments, the finger pockets of the glove body include first joint portions that correspond to the proximal interphalangeal joints of a wearer's hand, and the palm flap is connected to the glove body adjacent the first joint portions. The protective glove may include a removable backhand liner releasably connected to the inside surface of the glove body, and it may also include a removable wrist liner releasably connected to an inside surface of the cuff. Preferably, the flexible releasable fasteners comprise hook and loop type fasteners, such as VELCRO™ type fasteners. In some embodiments, the palm flap includes an outside edge portion having the fasteners and the glove body includes a corresponding outside edge flap having fasteners and that overlays the outside edge portion, wherein the outside edge flap releasably connects to the outside edge portion when the palm flap in positioned against the glove body.

In another aspect of the invention, there is provided a protective glove for ice hockey, or similar sports requiring a glove with padding on the back of the hand, comprising a glove body having a padded cuff, an interior surface and an exterior surface that is substantially covered with padding, the glove body further including a plurality of finger pads and a thumb pad, a palm flap having an interior surface, an exterior surface, a plurality of finger pockets adapted for receiving a wearer's fingers, and a plurality of finger pad pockets located above the finger pockets and being adapted to releasably receive the finger pads of the glove body to enable the palm flap to be releasable connected to the glove body such that the interior surface of the palm flap can be positioned to face the interior surface of the glove body, the palm flap further including a thumb pad pocket adapted to receive the thumb pad of the glove body, and an adjacent thumb pocket for receiving the wearer's thumb, a plurality of flexible releasable fasteners situated along the periphery of the palm flap and at corresponding locations on the glove body for releasably connecting the palm flap to the glove body such that the palm flap and the glove body define a hand cavity when they are connected that communicates with the finger pockets. The protective glove may further include a removable backhand liner releasably connected to the inside surface of the glove body, as well as a removable wrist liner releasably connected to an inside surface of the cuff. Preferably, the flexible releasable fasteners comprise hook and loop type fasteners. In some embodiments, the palm flap includes an outside edge portion having the fasteners and the glove body includes a corresponding outside edge flap having fasteners and that overlays the outside edge portion, wherein the outside edge flap releasably connects to the outside edge portion when the palm flap in positioned against the glove body.

Other aspects and features of the present invention will become apparent to those of ordinary skill in the art upon review of the following description of specific embodiments of the invention in conjunction with the accompanying figures.

BRIEF DESCRIPTION OF THE DRAWINGS

For a better understanding of the present invention and to show more clearly how it may be carried into effect, reference will now be made by way of example to the accompanying drawings in which.

DETAILED DESCRIPTION

Figure 1:
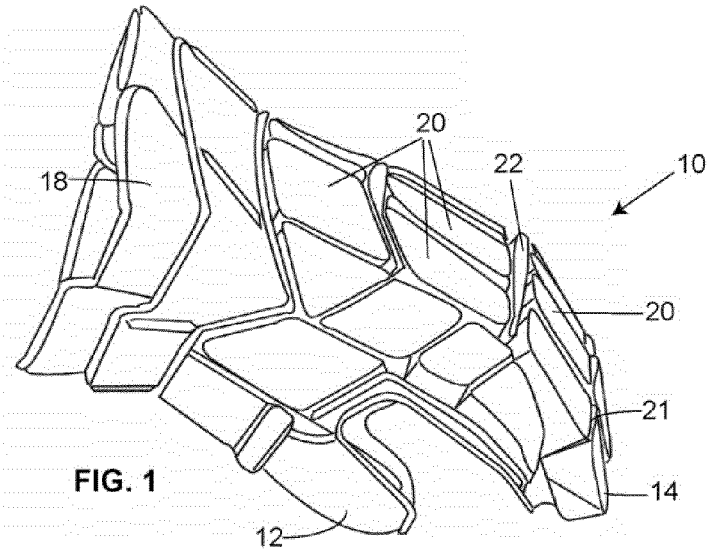
FIG. 1 is a left side perspective view of a hockey glove for a left hand showing primarily the thumb support and forefinger support in the foreground, and the padding on the backside of the glove.

For the purposes of promoting an understanding of the principles of the invention, reference will now be made to the exemplary embodiments illustrated in the drawings, and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would occur to one skilled in the relevant art and having possession of this disclosure, are to be considered within the scope of the invention. Therefore, specific details disclosed herein are not to be interpreted as limiting, but rather as a basis for the claims and as a representative basis for teaching one skilled in the art to employ the present invention.

Figure 2:
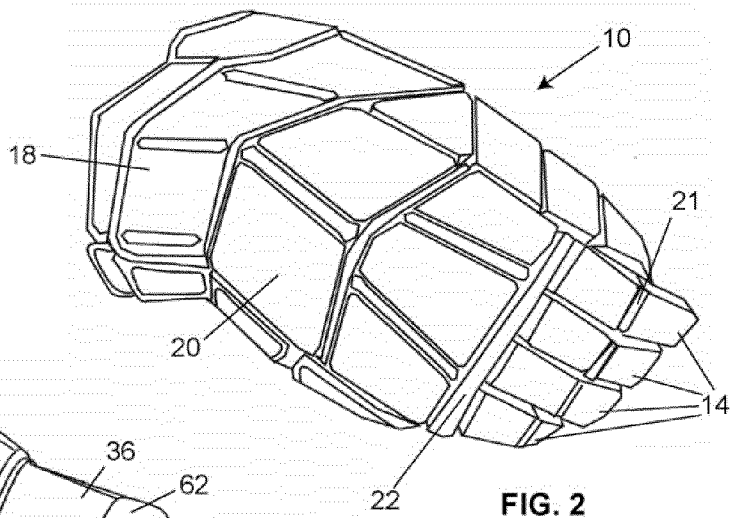
FIG. 2 is a top plan view of the glove in FIG. 1.

Referring to FIGS. 1 and 2, a protective sports glove such as hockey glove in accordance with an embodiment of the present invention is shown generally at 10. Hockey glove 10 includes a padded thumb support 12 having an internal thumb pocket, padded finger supports 14 each with an internal finger pocket, and padded wrist cuff 18. The back and lateral sides of the hockey glove 10 are provided with a plurality of protective pads 20 for absorbing impacts to the back of a user's hand. The protective pads 20 are arranged to generally correspond with the bone structure of a user's hand and include first joint portions 21 of the glove corresponding to the proximal interphalangeal finger joints, and second joint portions 22 corresponding to the metacarpophalangeal joints to provide flexibility for enabling the glove to articulate in conjunction with the user's hand.

Figure 3:
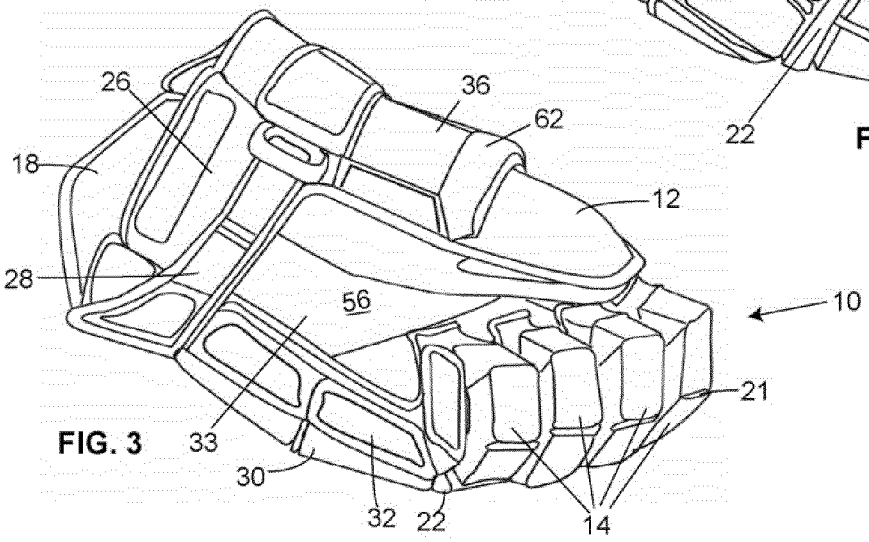
FIG. 3 is a perspective view of the bottom of the glove in FIG. 1.

Referring to FIG. 3, hockey glove 10 is shown palm side up and has a wrist flap 26 and a wrist strap 28. Along the bottom edge 30 opposite to the thumb is an edge flap 32. And on the thumb support 12 there is provided an outer thumb flap 34. In FIG. 3, the wrist flap 26, the wrist strap 28, the bottom edge flap 32 and the outer thumb flap 36 are shown in a closed configuration.

Figure 4:
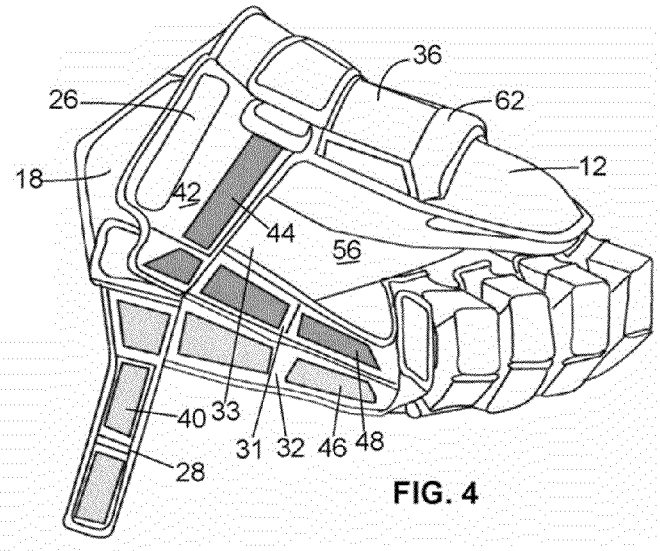
FIG. 4 is a perspective view of the bottom of the glove in FIG. 1 showing the wrist strap disengaged from wrist flap, and the bottom edge flap disengaged from the lateral edge portion of the palm flap.

Referring to FIG. 4, hockey glove 10 is shown palm side up with the wrist strap 26 and the bottom edge flap 32 shown in an open configuration. These are held in the closed configuration by means of hook and loop type fasteners, such as Velcro™ fasteners. Thus in FIG. 4, the wrist strap has the hook portions 40 of the fasteners on its underside and the outer surface 42 of wrist flap 26 has the loop portions 44 such that the wrist strap 28 can be releasable fastened to the outer surface of the wrist flap 26. Likewise, the inside surface of the edge flap 32 has the hook portions 46 of the fasteners and the outside surface of the edge portion 31 has the loop portions 48 of the fasteners. Accordingly, the wrist strap 28 can be fastened to the outer surface 42 of the wrist flap 26 and the edge flap 32 can be fastened to the edge portion 31 of the palm panel or flap 33.

Figure 5:
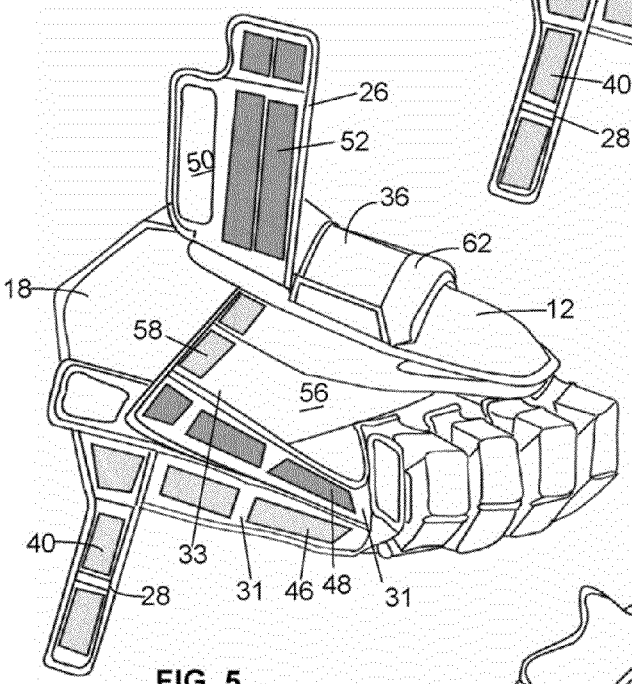
FIG. 5 is a bottom perspective view of the glove in FIG. 4 further showing the wrist flap disengaged the palm flap.

Referring to FIG. 5, hockey glove 10 is shown palm side up with the wrist strap 28, the bottom edge flap 32 and the wrist flap 26 shown in an open configuration. The inside surface 50 of the wrist flap 26 has loop portions 52 of the hook and loop fasteners and the outer surface 56 of the palm panel flap 33 has corresponding hook portions 58 of the hook and loop fasteners for fastening the wrist flap 26 onto the palm panel 33.

Figure 6:
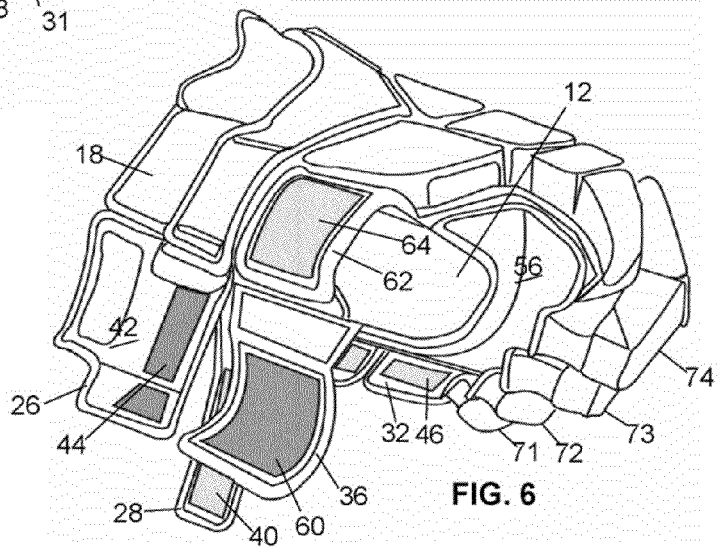
FIG. 6 is a left perspective view of the glove in FIG. 5 further showing the outer thumb flap disengaged the inner thumb flap.

Referring to FIG. 6, glove 10 is shown thumb side up and the outer thumb flap 36 is in an open configuration, as are the writs flap 26 and the wrist strap 28. The inside surface of the outer thumb flap 36 has a hook portion 60 and the outer surface of inner thumb flap 62 has a corresponding loop portion 64 of a hook and loop fastener for fastening the outer thumb flap 36 to the inner thumb flap 62. Note that inner thumb flap 62 comprises padding material and provides additional protection for the thumb. Also illustrated in this Figure is the ergonomic curvature of the finger supports 14 in which the pinky finger support 71 is curved the most inward, followed by the ring finger support 72, the middle finger support 73 and finally the index finger support 74 which has the least amount of curvature. The ergonomic curvature of the finger supports 14 mimics the curvature of a hand when in a grasping posture used for grasping a hockey stick or like game playing implement.

Figure 7:
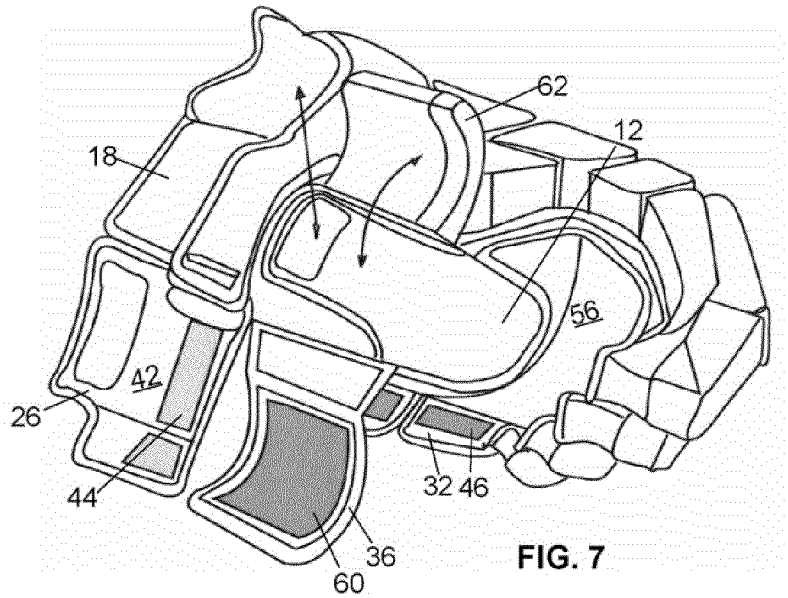
FIG. 7 is a left perspective view of the glove in FIG. 6 further showing the inner thumb flap displaced from the thumb support.

Referring to FIG. 7, glove 10 is show in a similar orientation as in the previous figure but with the inner thumb flap 62 in an open configuration in which it is folded away from the thumb support 12.

Figure 8:
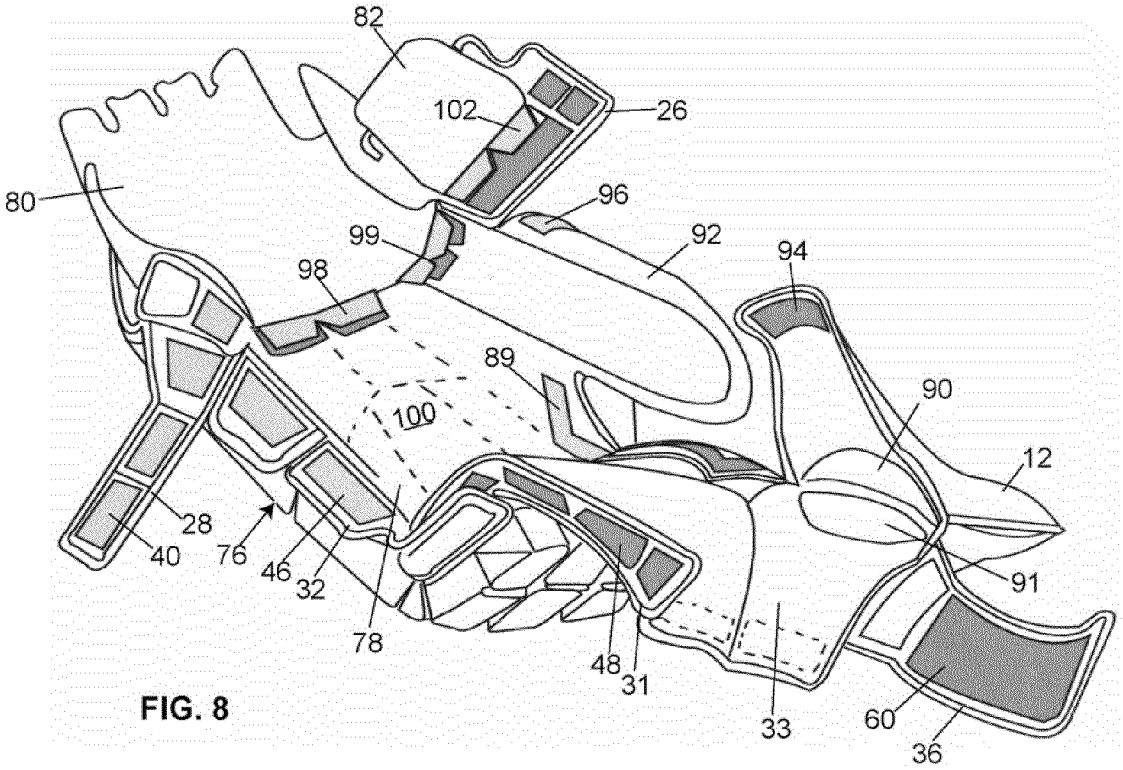
FIG. 8 is a bottom perspective view of the glove in FIG. 7 further showing the palm flap disengaged from the glove body.
Figure 9:
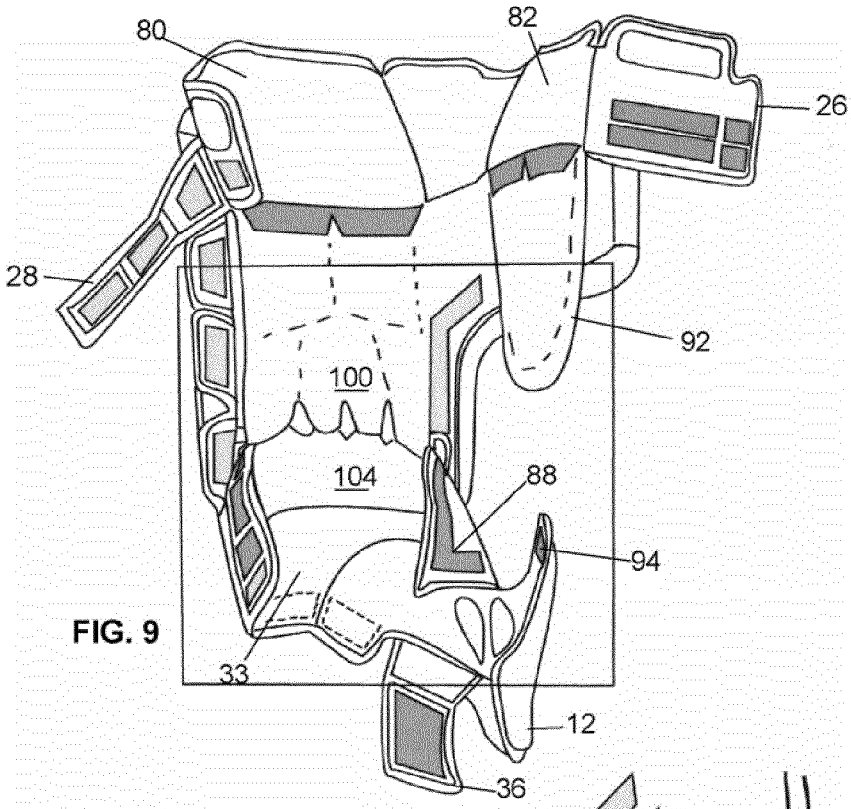
FIG. 9 is a top plan view of the glove in FIG. 8 in the open configuration.
Figure 10:
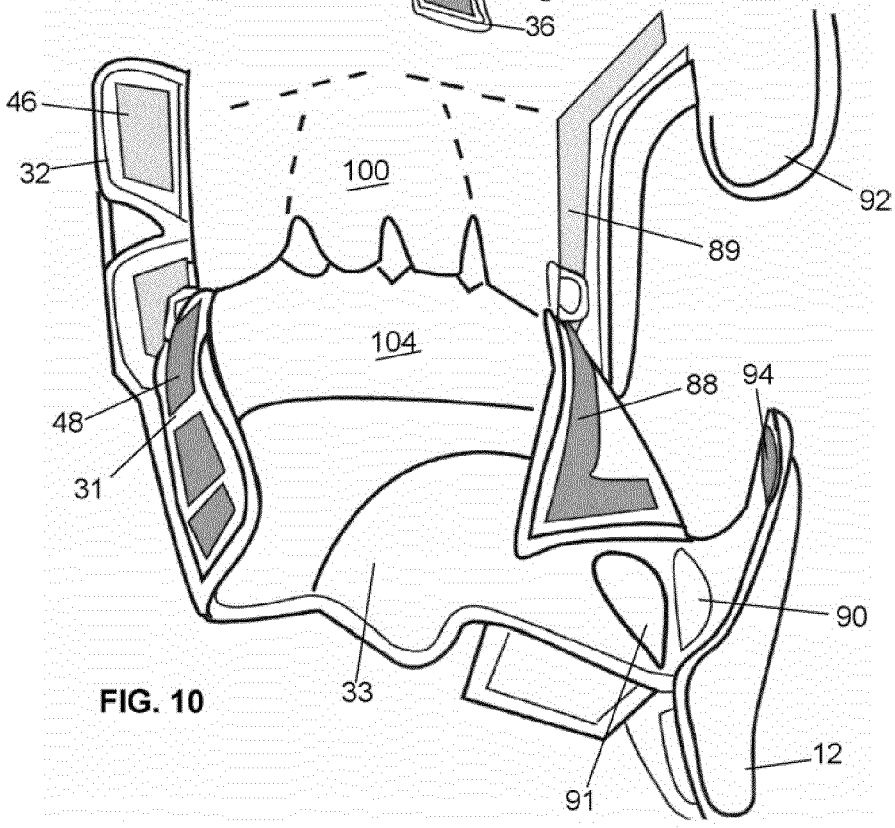
FIG. 10 is a close-up top plan view of a portion of the glove in FIG. 9.

Referring to FIGS. 8-10, glove 10 is shown completely open in which palm flap 33 is folded away from the main glove body 76 to expose the inside lining 78 and removable back hand moisture trap lining 80 and palm moisture trap lining 82. Palm flap 33 is integral with the body of glove 10 from the end of the finger supports up to the second joints of the finger supports, corresponding to the proximal interphalangeal joints of the fingers, thereby defining finger pockets for receiving the wearer's fingers. Otherwise, the palm flap 33 is releasably fastened to the body of the glove 10 by hook and loop type fasteners, such as Velcro™ fasteners. In other embodiments, the palm flap may be integral with the body of the glove up to the knuckle joints (metacarpophalangeal joints) of the finger supports, or alternatively, to the first (distal interphalangeal joints).

However, higher points at which the palm flap is connected to the glove body are preferred so that the finger pockets in the glove body are longer for a better fit of the glove to the wearer's fingers, which enables better stick handling control.

Along the bottom edge of the glove, the palm flap 33 is fastened to the glove body by the edge flap 32. Along the opposite side of the glove adjacent the thumb, the palm flap 33 is fastened to the body of the glove by releasable engagement of hook portion 88 on the palm flap 33 with the corresponding loop portion 89 adjacent the thumb. The palm flap 33 and the glove body 76 thereby define palm cavity in which the wearer's is received in the glove. The thumb support 12 is integral with the palm flap 33 and it defines a thumb pad pocket 90 and a thumb pocket 91 to receive the wearer's thumb. The glove body 76 has thumb pad 92 which fits within the thumb pad pocket 90 of the thumb support 12 and, during the act of closing the glove, the thumb pad 92 is positioned within the thumb pad pocket 90 as palm flap 33 is brought towards the glove body 76 and then fastened thereto as described above. The thumb pad 92 is releasable fastened to the thumb pad pocket 90 by the releasable engagement of hook portion 94 on the inside of said pocket with loop portion 96 on the outside of thumb pad 92. A moisture back hand moisture trap liner 80 shown folded back toward the wrist is releasably fastened to the glove body 76 at a location adjacent the wrist portion by means of hook and loop fasteners 98 and at a location adjacent the base of the thumb by means of hook and loop fasteners 99. In its operable position with the glove closed, the back hand moisture trap liner 80 lays against the inside surface 100 of the glove body 76, and may comprise a hydrophilic layer such as cotton on the side that faces the inside surface 100 of the glove body, and a hydrophobic layer such as NYFOAM™ on the side that faces the back of the wearer's hand. The NYFOAM™ absorbs the moisture from the back of the wearer's hand and the cotton traps the moisture. However, other materials suitable for hockey glove liners may be substituted. A wrist moisture trap liner 82, shown folded back towards the wrist, is releasably fastened to the inside surface of wrist flap 26 by means of hook and loop fasteners 102. In its operable position with the glove closed, the wrist moisture trap liner 82 lays against the inside surface 104 of the palm flap 33, adjacent the wrist, and it has a similar construction as the back hand moisture trap liner 80 wherein the NYFOAM™ side rests against the wearer's wrist and the cotton side against the inside surface 104. Both of the moisture trap liners may be removed from the glove and are washable, or may be replaceable with replacement moisture trap liners.

The glove 10 in the open configuration as show in FIGS. 8-10 exposes the inside liners and the finger cavities to the atmosphere to enable the glove to be dried quickly after use, which reduces the build up of bacteria. Also, the moisture trap liners may be removed and dried, washed or replaced. Once the glove is dry, it may be closed as follows in preparation for use. The backhand moisture trap liner 80 is folded downward so that it lays against the inside surface 100 of the glove body 76. The palm flap 33 is brought toward the glove body 76 and the thumb pad 92 is inserted into the thumb pad pocket 90. The palm flap is secured to the glove body 76 by fastening the loop portion 46 to the hook portions 48 along the edge of the glove and the loop portion 89 to the hook portions 88 adjacent the thumb side of the glove. The thumb pad 92 is secured to the thumb support 12 by fastening the loop portion 96 to the hook portion 94. The wrist flap 26 is secured to the outside surface of the palm flap by fastening the loop portion 52 to the hook portions 58. The wrist moisture trap 82 is folded into the glove cavity, now defined by the glove body and the palm flap, so that it lays against the inside surface of the palm flap at a location adjacent the wearer's wrist. The inner thumb flap 62 is folded against the thumb support 12, and the outer thumb flap 36 is folded over and secured to the inner thumb flap by fastening the hook portion 60 to the loop portion 64. And finally, the wrist strap 28 is secured to the outer surface 42 of the wrist flap 26 by fastening the hook portions 40 to the loop portions 44. Minor adjustments to the position of the various straps and flaps may be made by selectively unfastening certain of the hook and loop fasteners, repositioning them relative to each other, and then refastening them. The assembled glove is ready to use and provides a hockey glove that advantageously has the protective qualities of a conventional hockey glove, provides a good, secure fit for the wearer, provides the requisite amount of flexibility for stick handling, while at the same time it enables the glove to be opened to expose the inner liners for the purposes of drying or cleaning. And in some embodiments, removable liners are also provided which may be washed or replaced in their entirety. The opening of the glove to expose the liners is accomplished in reverse order.

Figure 11:
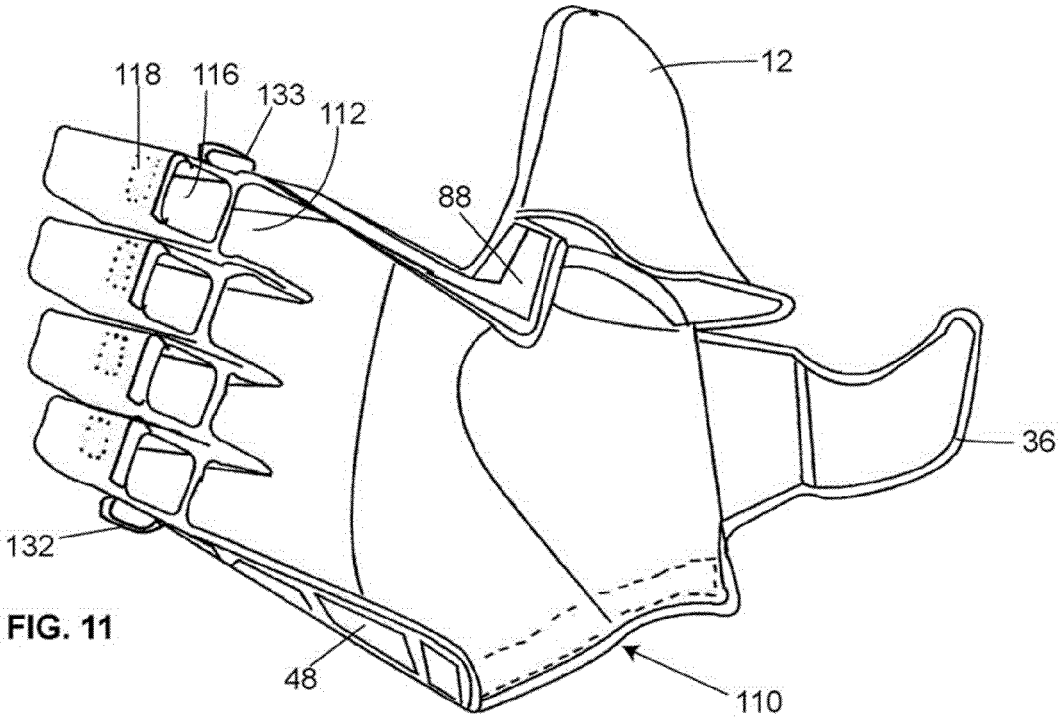
FIG. 11 is a right rear perspective view of a palm flap from another embodiment of the present invention showing the inside surface of the palm flap with its finger pockets, finger pad pockets and thumb support.
Figure 12:
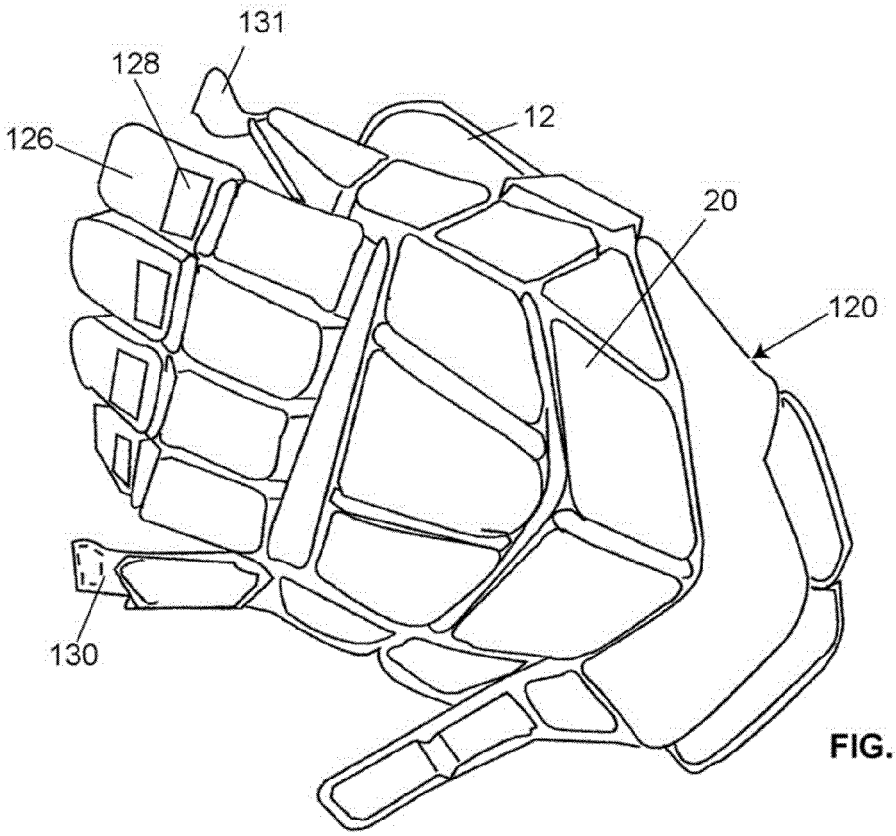
FIG. 12 is a top plan view of a glove body that releasably connects with the palm flap of FIG. 11 in the steps of assembling the glove of this second described embodiment.
Figure 13:
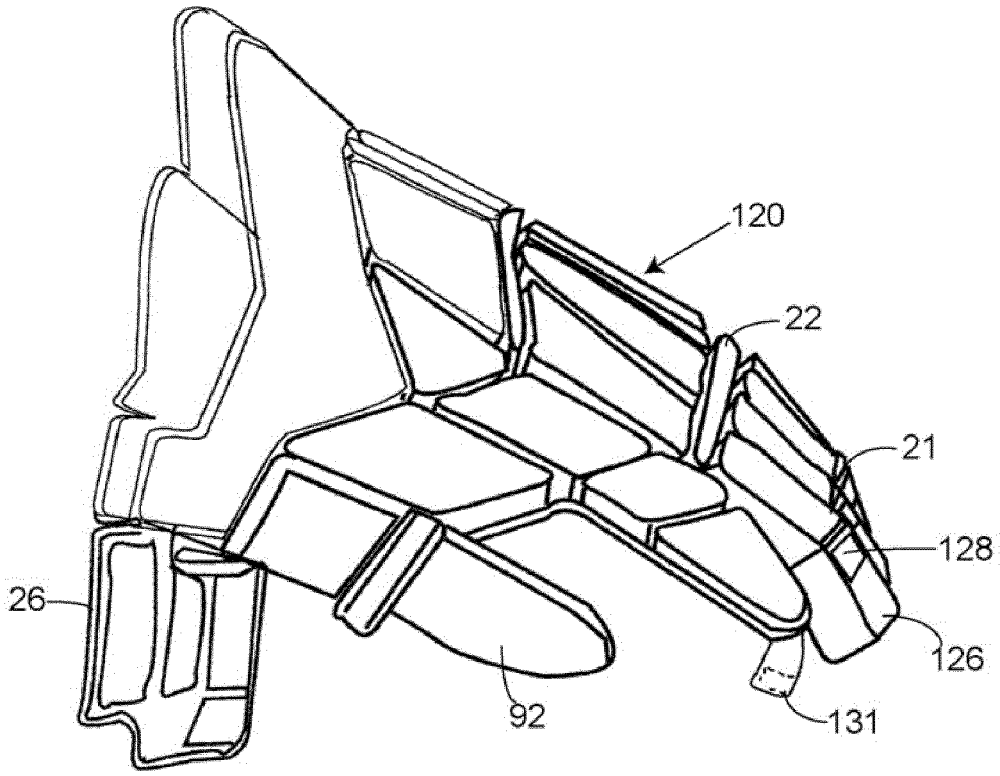
FIG. 13 is a left perspective view of the glove body of FIG. 12.
Figure 14:
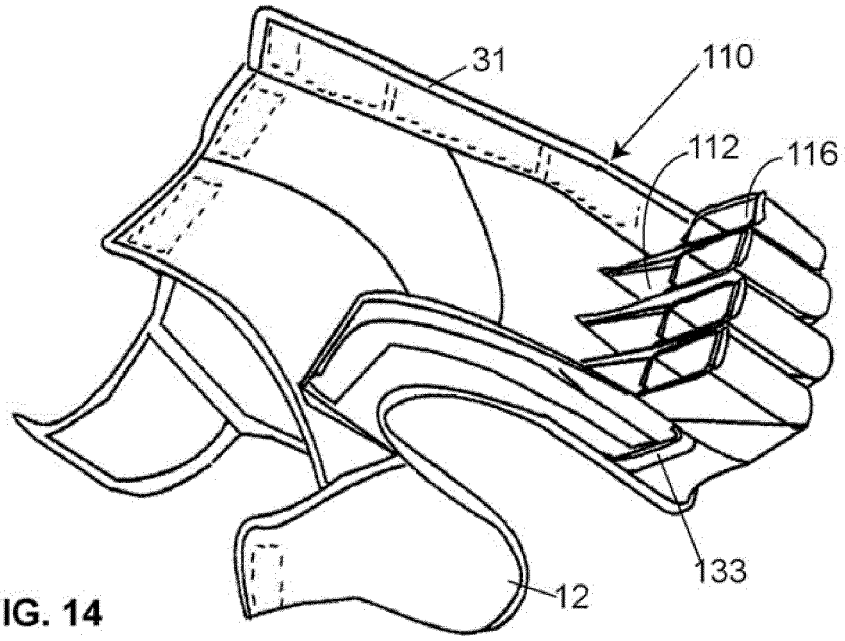
FIG. 14 is a left perspective view of the palm flap of FIG. 11.

Referring to FIGS. 11-16, there is shown another embodiment of the present invention in which the palm flap and the glove body are completely separable which allows for either part to be replaced as required. With reference to FIGS. 11 & 14, palm flap 110 is similar to the previously described embodiment except that it includes finger pockets 112 for receiving the fingers of a wearer's hand, and above the finger pockets is provided finger pad pockets 116. Referring to FIGS. 12 & 13, the glove body 120 is similar to the embodiment previously described with the exception that the finger supports are not provided with finger pockets, but instead they terminate in distal finger pads 126. The finger pad pockets 116 of the palm flap 110 are adapted to receive the distal finger pads 126 of the glove body 120 and thereby function to releasably connect the palm flap 110 to the glove body 120 for enabling the glove to be assembled. The releasable connection is achieved by the close fit of the distal finger pads 126 into the finger pad pockets 116, and is further enhanced by releasable fasteners, such as a hook and loop type fasteners provided on the outside of the distal finger pads and at a corresponding location on the inside of the finger pad pockets. Specifically, loop portions 128 of the hook and loop fasteners are provided on the distal finger pads 126, and hook portions 118 are provided on the inside of the finger pad pockets 116. Once the distal finger pads 126 of the glove body are inserted into the finger pad pockets 116 of the palm flap, releasable loop straps 130 and 131 on the glove body 120, each comprising of a strip of material having hoop and loop fasteners at its base and tip respectively, is threaded through loops 132 and 133 respectively on the palm flap 110 and secured to itself to enhance the connection between the palm flap and the glove body.

Figure 15:
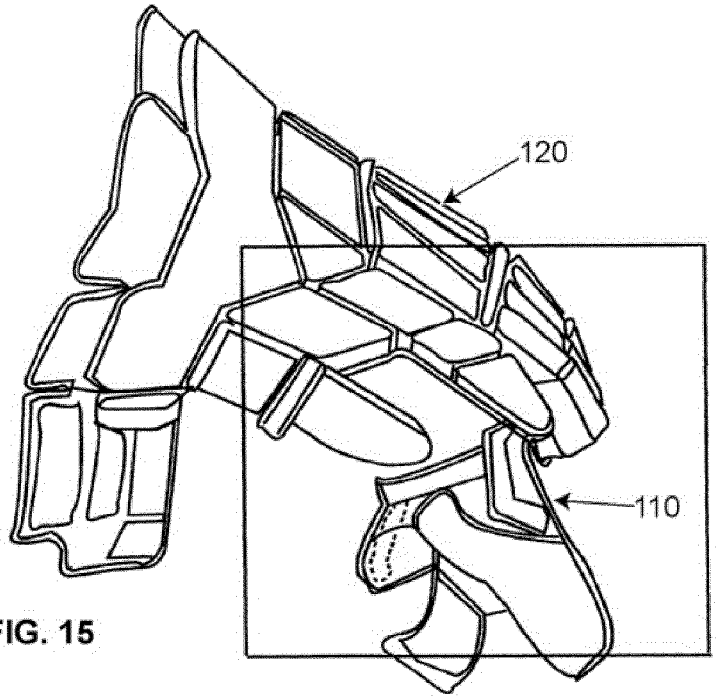
FIG. 15 is left perspective view of the palm flap of FIG. 11 connected to the glove body of FIG. 12 in a partially assembled glove.
Figure 16:
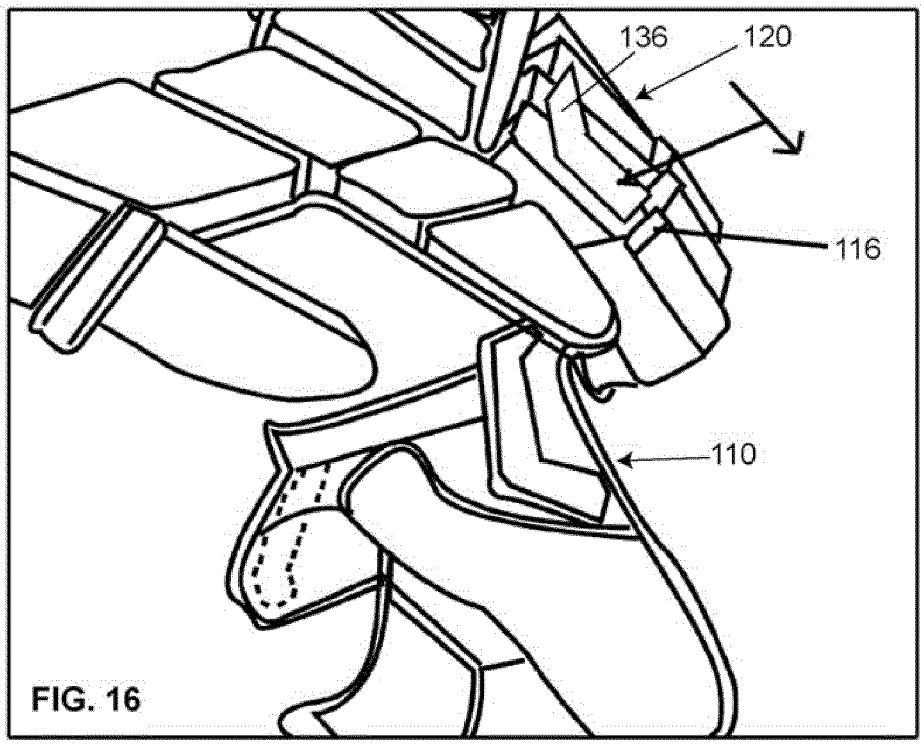
FIG. 16 is close up of a portion of the glove of FIG. 15.

FIGS. 15 & 16 show the palm flap 110 connected to the glove body 120 wherein the distal finger pads 126 are received within the finger pad pockets 116. From this stage, the hockey glove may be assembled or closed in preparation for use as described in the previous embodiment. And, once closed, the glove may be opened to the configuration as shown in FIG. 15 by reversing the steps previously described. From the configuration as shown, the palm flap 110 may be separated from the glove body 120 by inserting a flat, rigid tool 136 into the finger pad pockets 116 in between the upper pocket wall and the distal finger pads 126 to separate the hook portions 118 from the loop portions 128 of the hook and loop fasteners, as shown in FIG. 16. Once the fasteners are separated, the distal finger pad may be withdrawn from its finger pad pocket. This is repeated with each finger support until all of the distal finger pads are withdrawn from the finger pad pockets, thereby disengaging the palm flap from the glove body.

While the above description and illustrations constitute preferred or alternate embodiments of the present invention, it will be appreciated that numerous variations may be made without departing from the scope of the invention.

What is claimed is:

1. A protective glove for hockey or similar sport requiring a glove with padding on the back of the hand, the protective glove comprising:

a glove body having a backside and a padded cuff, an interior surface and an exterior surface that is substantially covered with padding, the glove body further including a plurality of finger pockets and a thumb pad;

a palm flap having an interior surface and an exterior surface and being integrally connected to the glove body adjacent the opening of the finger pockets such that the interior surface of the palm flap can be positioned to face the interior surface of the glove body, the palm flap further including a thumb pad pocket adapted to receive the thumb pad of the glove body, and an adjacent thumb pocket for receiving the wearer's thumb; and a plurality of flexible releasable fasteners situated along a periphery of the palm flap and at corresponding locations on the glove body for releasably connecting the palm flap to the glove body such that the palm flap and the glove body define a hand cavity when they are connected that communicates with the finger pockets.

2. The protective glove of claim 1, wherein the finger pockets of the glove body include first joint portions that corresponds to proximal interphalangeal joints of a wearer's hand, and the palm flap is connected to the glove body adjacent the first joint portions.

3. The protective glove of claim 2, further comprising a removable backhand liner releasably connected to the interior surface of the glove body.

4. The protective glove of claim 1, further comprising a removable backhand liner releasably connected to the interior surface of the glove body.

5. The protective glove of claim 4, further comprising a removable wrist liner releasably connected to an inside surface of the cuff.

6. The protective glove of claim 5, wherein the flexible releasable fasteners comprise hook and loop type fasteners.

7. The protective glove of claim 1, wherein the palm flap includes an outside edge portion having the fasteners and the glove body includes a corresponding outside edge flap having fasteners and that overlays the outside edge portion, wherein the outside edge flap releasably connects to the outside edge portion when the palm flap in positioned against the glove body.

8. A protective glove for hockey or similar sports requiring a glove with padding on the back of the hand, the protective glove comprising:

a glove body having a backside and a padded cuff, an interior surface and an exterior surface that is substantially covered with padding, the glove body further including a plurality of finger pads and a thumb pad;

a palm flap having an interior surface, an exterior surface, a plurality of finger pockets adapted for receiving a wearer's fingers, and a plurality of finger pad pockets located above the finger pockets and being adapted to releasably receive the finger pads of the glove body to enable the palm flap to be releasable connected to the glove body such that the interior surface of the palm flap can be positioned to face the interior surface of the glove body, the palm flap further including a thumb pad pocket adapted to receive the thumb pad of the glove body, and an adjacent thumb pocket for receiving the wearer's thumb; and a plurality of flexible releasable fasteners situated along a periphery of the palm flap and at corresponding locations on the glove body for releasably connecting the palm flap to the glove body such that the palm flap and the glove body define a hand cavity when they are connected that communicates with the finger pockets.

9. The protective glove of claim 8, further comprising a removable backhand liner releasably connected to the interior surface of the glove body.

10. The protective glove of claim 9, further comprising a removable wrist liner releasably connected to an inside surface of the cuff.

11. The protective glove of claim 9, wherein the flexible releasable fasteners comprise hook and loop type fasteners.

12. The protective glove of claim 8, wherein the palm flap includes an outside edge portion having the fasteners and the glove body includes a corresponding outside edge flap having fasteners and that overlays the outside edge portion, wherein the outside edge flap releasably connects to the outside edge portion when the palm flap in positioned against the glove body.

* * * * *